US008220853B2

(12) United States Patent
Maeder

(10) Patent No.: US 8,220,853 B2
(45) Date of Patent: Jul. 17, 2012

(54) CLAMPING ELEMENT FOR FITTING ON A CLAMPING TONGUE OF A GRIPPER AS WELL AS GRIPPER FITTED WITH SUCH A CLAMPING ELEMENT

(75) Inventor: Carl Conrad Maeder, Hittnau ZH (CH)

(73) Assignee: Ferag AG, Hinwil (CH)

( * ) Notice: Subject to any disclaimer, the term of this patent is extended or adjusted under 35 U.S.C. 154(b) by 140 days.

(21) Appl. No.: 12/571,817

(22) Filed: Oct. 1, 2009

(65) Prior Publication Data

US 2010/0084882 A1 Apr. 8, 2010

(30) Foreign Application Priority Data

Oct. 2, 2008 (CH) ..... 1561/08

(51) Int. Cl.
*B66C 1/44* (2006.01)
*B25J 15/00* (2006.01)

(52) U.S. Cl. ..... 294/99.1; 294/106

(58) Field of Classification Search ..... 294/99.1, 294/103.1, 104, 106, 901, 86.4; 270/52.14, 270/52.19; 198/803.9, 803.7; 271/204, 277
See application file for complete search history.

(56) References Cited

U.S. PATENT DOCUMENTS

| | | | | |
|---|---|---|---|---|
| 4,381,056 | A | 4/1983 | Eberle | |
| 5,388,820 | A * | 2/1995 | Eberle et al. | 271/277 |
| 5,395,151 | A | 3/1995 | Eberle | |
| 5,575,379 | A * | 11/1996 | Schmetzer | 198/803.9 |
| 6,161,827 | A * | 12/2000 | Eugster et al. | 198/803.1 |

FOREIGN PATENT DOCUMENTS

| | | |
|---|---|---|
| DE | 3102242 | 2/1982 |
| EP | 0600183 | 6/1994 |
| GB | 2068892 | 8/1981 |
| WO | 2007/115421 | 10/2007 |

* cited by examiner

*Primary Examiner* — Paul T Chin
(74) *Attorney, Agent, or Firm* — Rankin, Hill & Clark LLP

(57) ABSTRACT

A clamping element for attaching a gripper onto a clamping tongue as well as a gripper with this kind of clamping element is provided. The clamping element has a longitudinal carrier the width of which substantially corresponds to the width of the clamping tongue and at least two mutually distanced clamping regions. At least one fastening element for the detachable fastening of the clamping elements to the clamping tongue (42, 44) is provided. The clamping element provides an improved force division as well as a secure support on the clamping tongue.

17 Claims, 3 Drawing Sheets

44
1'
42
53
55
43,43'
10
1
1.1
56
20
52
51
1.2
12
13
1.3
62
32
1.4
63

CLAMPING ELEMENT FOR FITTING ON A CLAMPING TONGUE OF A GRIPPER AS WELL AS GRIPPER FITTED WITH SUCH A CLAMPING ELEMENT

BACKGROUND OF THE INVENTION

1. Field of the Invention

The invention is in the field of conveying technology. It pertains to a clamping element for fitting onto a clamping tongue of a gripper as well as a gripper with this kind of clamping element.

2. Description of Related Art

The publication WO 2007/115421 describes a gripper comprising two clamping tongues as well as a means for generating a clamping force. The clamping tongues are pivotable in relation to one another on a pivot axis between two extreme positions, which corresponds to an open or closed configuration of the gripper respectively. At least one of the clamping tongues comprises, on its outer edge, two laterally protruding springing arms, i.e. protruding in parallel to the pivot axis. On these arms per clamping tongue two clamping elements are attached, in order to divide the clamping force between the two points or regions respectively and to make it uniform within these clamping regions.

Clamping elements, which, as described in WO 2007/115421, are attached only by attaching them on the clamping tongues, have the disadvantage that they may come off the clamping tongues during operation, in particular in that the small displacements occurring during operation add up, such that the clamping element falls off the arm laterally.

A rubber coating fixed permanently to the clamping tongue is already known from DE-A 310 22 42. The rubber coating is on the one hand to protect the product from being damaged and on the other hand to increase the adhesion between the clamping tongues and the product. The clamping tongue is, however, compared to the objects to be gripped, relatively narrow. On the other hand the clamping force is exerted over an extended region. With objects with variations in thickness, e.g. due to inserted products this may lead to the clamping force being concentrated to one single point, namely the location of the greatest thickness, and the held objects may twist around this point.

The invention, thus, has the object to provide a clamping element for grippers, which in case of wear may be easily exchanged, in mounted condition, however, is reliably fixed to the clamping tongue of the gripper and is, thus, suitable for continuous duty. Apart from this it is a further object of the invention to guarantee a reliable clamping effect and a stable product position.

The clamping element according to the invention is adapted to grippers on which at least one clamping tongue is formed in a T-shape, i.e. comprises two arms laterally protruding from a central clamping tongue part. For removable fastening of the clamping element to the clamping tongue at least one fastening element, preferably two fastening elements are provided. With the fastening element(s), the clamping element may be fitted to the clamping tongue in a planar manner or in several fastening locations respectively. According to the invention, the clamping element has a lengthy carrier, the width of which substantially corresponds to the width of the clamping tongue in the region of the arms, which thus can cover the arms over their complete width. For secure holding of an object, at least two distanced clamping regions are provided, which are arranged on the carrier such that they are located in the region of the arms in the case of use. The clamping regions may be designed in one piece with the carrier or they may be elements connected to the carrier, which define the clamping regions.

The invention thus suggests using, instead of several clamping elements fitted to the clamping tongue unilaterally, an extended carrier, on which at least two clamping regions are realised and which may be fastened to the arms of the clamping tongue in a suitable manner.

The term clamping region means the region of the clamping elements in which in the case of application the clamping forces are mainly transmitted to the held object. By means of the two or more independent clamping regions, a clamping effect concentrated to different regions is realised. A dislocation of the product is thus impeded even if it comprises variations in thickness in the held regions. This can be supported by fitting the arms on the central clamping tongue part in a springing manner, which thus may additionally compensate thickness variations. The clamping regions differ from the rest of the regions of the carrier, e.g. by having an enlarged cross section (e.g. cushion-type swelling in the carrier) and/or by means of the elasticity module, in particular lower compliance in clamping direction. In the clamping region, preferably a certain elasticity/flexibility is provided in order to make the clamped force constant over the clamped area by means of adaptation to the form of the counter element or to the product and in particular to achieve a frontal area running in parallel to the product or the counter element respectively.

By realising two or more clamping areas on the same carrier, these being allocated to the two arms arranged in symmetry to one another, forces can additionally be made constant, which act on the clamping element during operation and e.g. in the case of a carrier and clamping region allocated to only one arm, may lead to a detachment of the carrier.

The manner of the fastening on the clamping tongue is preferably adapted to the form of the clamping tongue, in particular the fastening elements act together with the clamping tongue by means of form or force engagement, e.g. by enclosing these or the two arms respectively between them. The fastening elements preferably limit the region in which the clamping element may be displaced in relation to the clamping tongue, such that no unintended detachment of the clamping element can occur. The fastening element is e.g. extended in a planar manner and reaches over the whole width of the clamping tongue. Alternatively, at least two mutually distanced fastening elements may be provided.

The fastening elements may e.g. be brackets with which the carrier is fitted to the clamping tongue and which reach over the complete width of the carrier or which may be arranged on the faces of the carrier. Fastening elements such as bolts or the like or a latching connection are also possible. In a preferred embodiment, the carrier itself is flexible at least in regions and may be deformed such that it can be applied onto the clamping tongue under the effect of force and in unstressed condition is held on it, in particular by form or force engagement.

The gripper according to the invention has, as known per se, a first and a second clamping tongue as well as a means for generating a clamping force, e.g. a spring. The clamping tongues each comprise on their distal ends clamping elements and are pivotable on a pivot axis in relation to each other such that the gripper may be brought into an open configuration or a closed configuration respectively, wherein the clamping elements of both clamping tongues lie upon each other or on the flat object in the closed configuration and are pressed against each other by the clamping force. At least one of the clamping tongues comprises two lateral arms, such that a T-shape is formed. At least one of the clamping elements is, as described above, designed with a lengthy carrier, at least two clamping regions and at least one fastening element and detachably fastened to the T-shaped clamping tongue.

Preferably, the clamping element substantially extends over the complete width of the clamping tongue including the arms and is preferably detachably fastened on both arms.

The invention has the advantage that the clamping elements, by means of the division of force onto two clamping regions enable a reliable holding of the objects by the gripper. They are easily exchangeable when worn or contaminated, however, are not displaced during operation or only to a low degree in relation to the clamping tongue.

BRIEF DESCRIPTION OF THE DRAWINGS

Examples of the invention are shown diagrammatically in the drawings and described in the following. Hereby FIGS. 1*a* and *b* show a gripper with a clamping element in different views.

DETAILED DESCRIPTION OF THE INVENTION

Figure 1A:
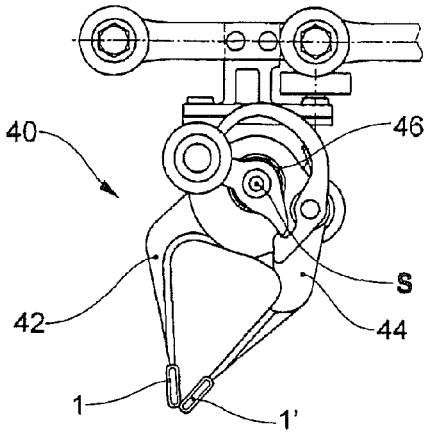
Figure 1B:
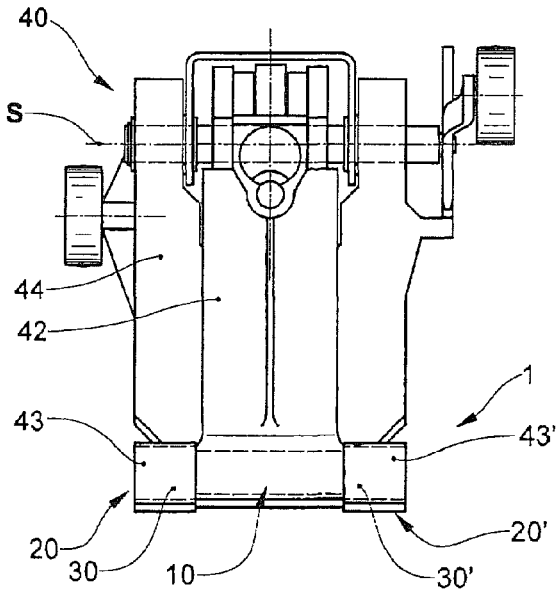

FIGS. 1*a* and *b* show a gripper 40 with two clamping tongues 42, 44, which are pivotable on a pivot axis S in relation to one another, in a view in the direction of the pivot axis (FIG. 1*a*) or in top view in perpendicular to it (FIG. 1*b*) respectively. With a means for creating a clamping force 46, e.g. a spring, the distal ends of the clamping tongues 42, 44 in closed condition of the gripper are pressed against each other or against the gripped product respectively. As shown in FIG. 1*b*, one of the clamping tongues 42 is designed in a T-shape and comprises laterally protruding arms 43, 43'. This kind of gripper is e.g. known from the publications DE-A310 2242 and WO 2007/115421 named at the outset and from EP-A 0 600 183, which is referenced here regarding the further construction and the mode of operation.

In order not to damage the product, to increase the extraction force in closed condition and to concentrate the clamping force to two regions, clamping elements 1, 1' are arranged on the distal edges of the clamping tongues 42, 44. The clamping element 1 fitted to the T-shaped clamping tongue 42 is designed according to the invention; the further clamping element 1' may be implemented in a conventional manner. The clamping element 1 according to the invention comprises a lengthy carrier 10, which extends over the complete width (viewed in direction of the pivot axis S) of the clamping tongue 42 in the distal region, i.e. including arms 43, 43'. The carrier 10 (partly drawn in broken lines) is on the other side of the clamping tongue 42 in viewing direction. On the outer ends of the carrier 10, two fastening elements 30, 30' are located with which the carrier 10 is held on the clamping tongue 42 or on the arms 43, 43' respectively, in particular fitted onto the arms 43, 43'. On the outer edges two clamping regions 20, 20' are furthermore provided, in which the clamping effect of the clamping element 1 is the largest. Due to the fact that the arms 43 and 43' are e.g. attached to the clamping tongue 42 in a springing manner and the clamping effect is concentrated by the form and elastic characteristics of the clamping element 1 on the clamping regions 20, 20', non-homogeneous product thicknesses may be compensated and the products held in a stable manner.

Figure 2A:
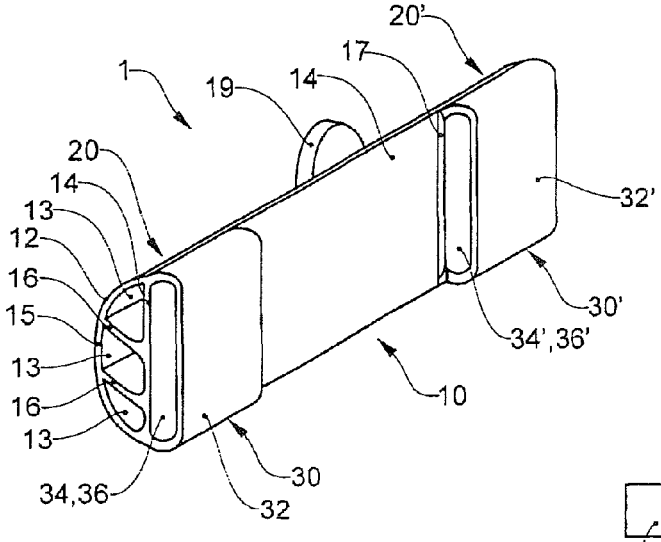
FIGS. 2*a* and *b* show a clamping element in different views.

FIGS. 2*a* and *b* show an example for a clamping element 1 with a lengthy carrier 10, which here is formed by a hollow profile 12 with several chambers 13 continuous in longitudinal direction. The carrier 10 comprises a basic layer 14 as well as a covering layer 15 arching over it. Between the basic layer and covering layer 14, 15 separating walls 16 run obliquely to the basic layer 14, which walls separate the chambers 13 from each other and under strain keep the covering layer at a (variable) distance from the basic layer 14. The basic layer 14 lies on the clamping tongue 42 in the case of operation, and the covering layer 15 is directed towards the object to be held or the other clamping tongue 44 respectively.

On the outermost edges of the carriers 10 two clamping regions 20, 20' are provided, by means of a distance between the covering layer 15 and the basic layer 14 being larger in the end regions than in the middle region. This is shown in an exaggeratedly strong manner in FIG. 2*b*. The clamping effect is thus mainly exerted in the end regions. The same effect could e.g. also be achieved with a homogenous thickness of the profile 12 by means of differing compliance in the end regions and in the intermediate middle region, e.g. by only providing the profile 12 with separating walls 16 inside in the end regions.

The oblique separating walls 16 have, among other things, the function of realising differing elasticity modules in the clamping regions 20, 20', in particular in order to impede a drawing out against the orientation of the separating walls 16 (here downwards) of the objects held between two clamping elements 1 and a flattening and thus to facilitate homogenising the force within the clamping region on force impact in the other direction. The cushion-like structure, thus, leads to a flattening of the clamping region and a homogenising of the clamping force, even if the clamping tongues as in the case of FIG. 1*a* meet at an angle. In order to secure the appropriate assembly, in the present case an orientation aid 19 is applied to the carrier 10.

In the end regions, two fastening elements 30, 30' are arranged on the side averted to the covering layer 15 of the carrier 10. These, here each comprise a hollow body 32, 32', which is formed in one piece with the carrier 10 and encloses a respective hollow space 34, 34'. The shape of the hollow space 34, 34' and the distance of the fastening elements 30, 30' is adapted to the form of the clamping tongue, here to arms protruding from it laterally. The hollow spaces 34, 34' have facing openings 36, 36' into which the arms may be stuck in the case of application, such that the clamping tongue is taken up between the fastening elements 30, 30'.

Figure 2B:
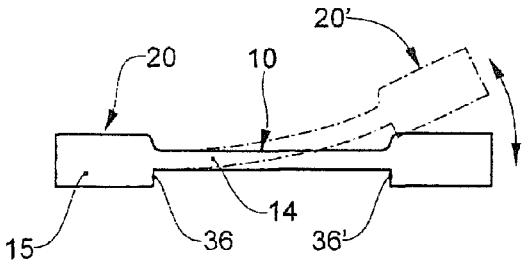

The clamping element 1 is made in one piece of an elastic material and, e.g. a thermoplastic material. As shown in FIG. 2*b*, the carrier 10 may be bent in perpendicular to its longitudinal direction in order to be able to put the clamping element onto the arms of the clamping tongue. In order to prevent material fatigue release slots 17 may be provided in the basic layer 14.

The clamping element 1 may be manufactured very cost-efficiently by means of mass production, e.g. by means of die-casting. Due to reasons in connection with die release the faces of the clamping element 1 in the shown example are open; they can also be closed if a different method of manufacture is used.

Figure 3:
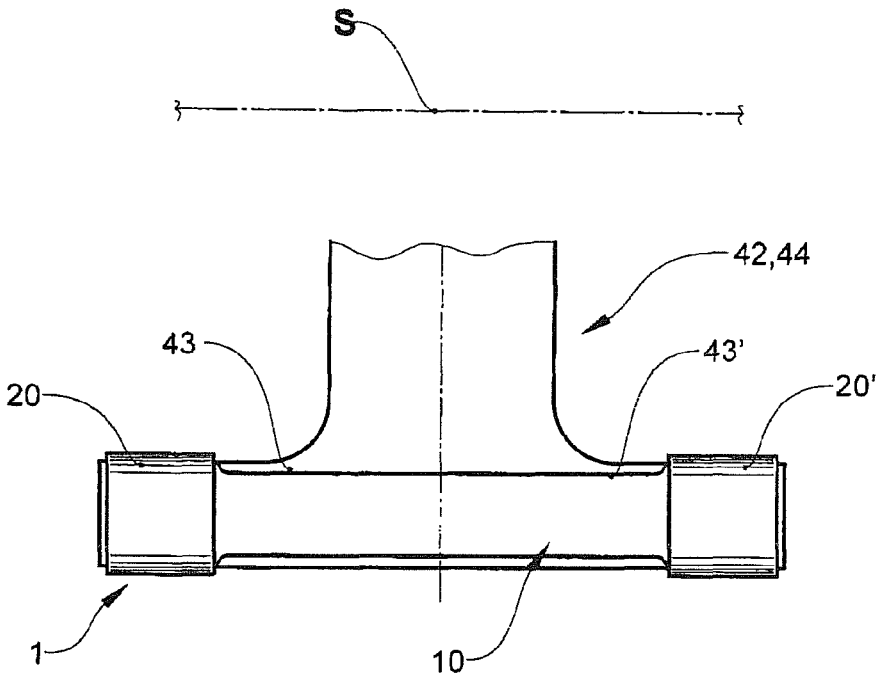
FIGS. 3 and 4 show a clamping tongue with clamping element.
Figure 4:
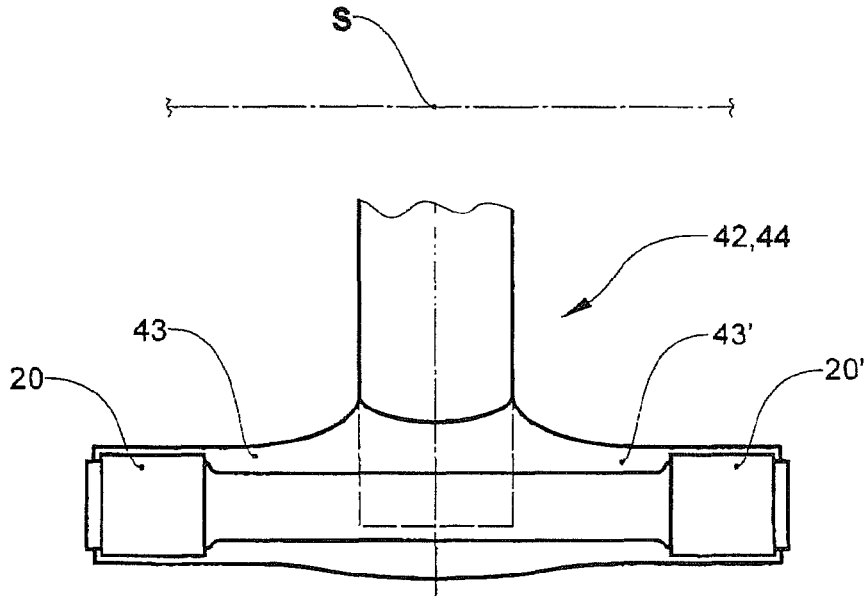

FIGS. 3 and 4 show different examples for clamping elements 1, which are attached to a clamping tongue 42, 44 or to arms 43, 43' protruding laterally from it. They are shown in views as directed towards the side of the clamping tongues 42, 44 facing the respective other clamping tongue, i.e. towards the clamping regions 43, 43'. In both examples, two respective clamping regions 20, 20' are provided, which are at a distance from one another and the position of which approximately corresponds to that of the arms 43, 43'. The clamping regions 20, 20' are connected to one another by the lengthy carrier 10 or are part of the carrier 10. The carrier 10, outside the clamping regions 20, 20', may simply be a material bridge.

In the example of FIG. 3, the end regions of the carrier 10 on the backside of the clamping regions 20, 20' are designed as fastening elements in the manner of a bush, e.g. as shown in FIGS. 2*a* and *b* and are applied to the arms 43, 43'. The elongated carrier 10, or the material bridge respectively, prevents the entire clamping element 1 from being disconnected from the clamping tongue 42, 44; a certain clearance, however, in the direction of the axis S is possible.

FIG. 4 shows that the arms 43, 43' may also be designed as a separate component, which is attached on the actual clamping tongue 42, 44. FIG. 4 shows an alternative fastening of the clamping element 1 to the arms, namely with hooks or clips attached to the end regions, which encompass the arms S in the direction of axis S and take them up between them.

FIGS. 5 through 8 show different examples for the design of the clamping elements 1 in the clamping regions 20, 20' in side view. In all figures, the clamping element 1' of the second clamping tongue 44 is a profile with a hollow space, which is formed, as e.g. in FIG. 4, on the separately designed arm. The hollow profile additionally comprises a deformable covering layer, which is directed towards the clamping element 1 of the first clamping tongue 42 and thus forms the supporting surface of the clamping element 1'.

The clamping elements 1.1 through 1.4 of the first clamping tongue 42 shown in FIGS. 5 through 8 are also shown separately a in three dimensional view.

Figures 5, 6, 7, 8:
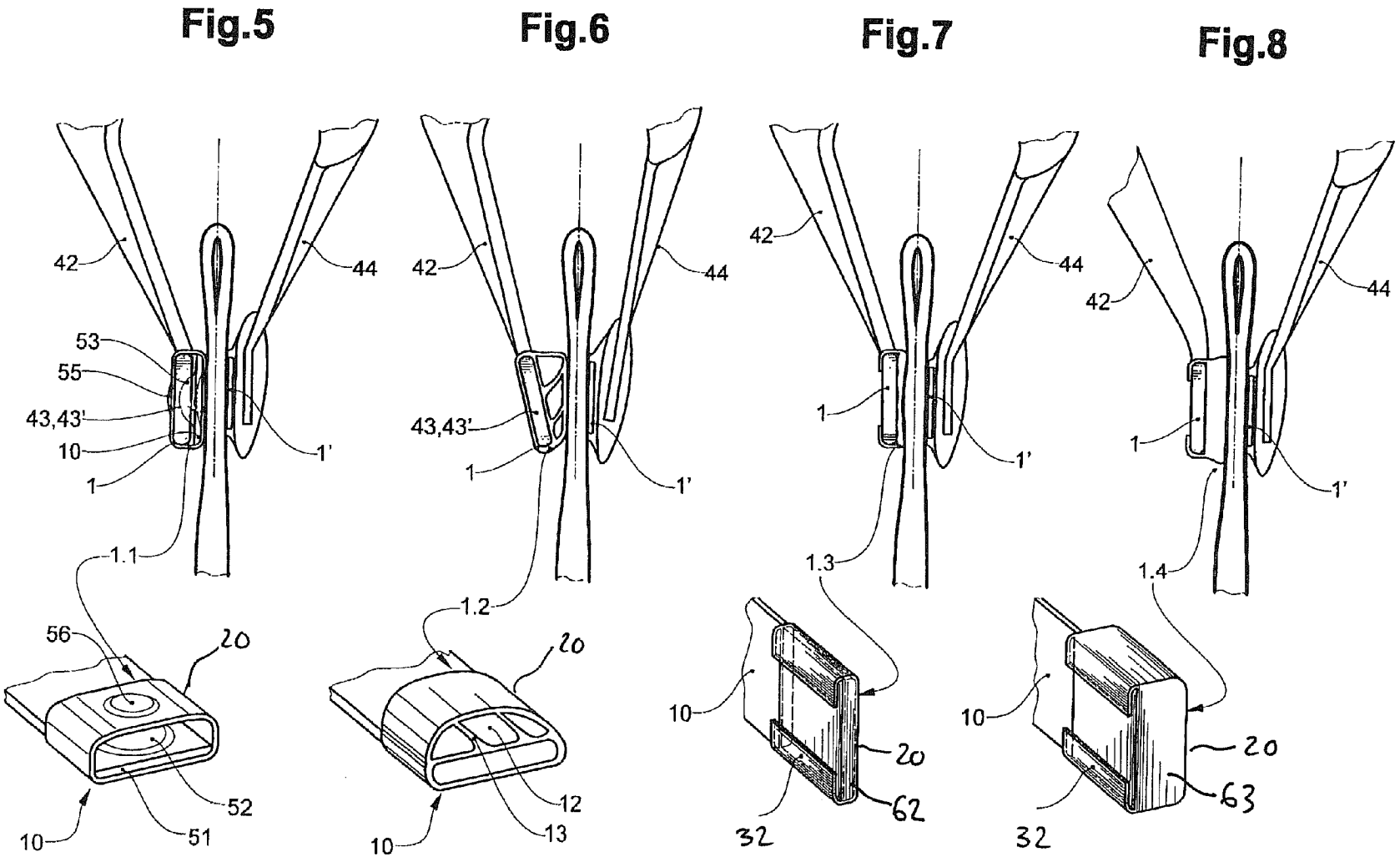
FIGS. 5-8 show different examples for the design of the clamping regions.

The clamping element 1.1 according to FIG. 5 is attachable to both arms 43, 43' from the free arm end. For this purpose it comprises a tubular restrictedly elastic carrier 10. In the end regions of the tubular carrier 10, an inner plate is arranged, which in its middle comprises a spherical recess 52 in its middle. The arms 43, 43' in a corresponding location comprise recesses 53 corresponding to the spherical recess 52, the depth of which is somewhat smaller than the height of the spherical recess 52. If the clamping element 1.1 is attached on the arms 43, 43' the spherical recesses 52 are positioned in the recesses 53, such that the plate 51 is supported over a ball joint on the arm 30. The inner plate 51 can thus adapt in all directions to the support surface of a counter clamping jaw or to a gripped object.

In FIG. 5, a recess 55 is additionally shown on the side of the arm 43, 43' averted from a gripped object, which, in cooperation with a convexity 56 of the tubular carrier 10 fixes the clamping element to the arm.

The clamping element 1.2 shown in FIG. 6 corresponds to the principle of the one shown in FIGS. 2*a* and 2*b*. It is again attachable from both sides to the arms 43, 43' and therefore comprises a tubular, restrictedly elastic carrier 10. On this carrier 10 a laterally open, e.g. multi-chambered hollow profile 12 is arranged, which forms a cushion-shaped supporting surface on preferably oblique supports 13.

FIG. 6 illustrates that the front surface of the clamping element 1 in clamping region 20 is adapted to the held product or to the counter element 1' respectively, although the two clamping tongues 42, 44 meet at an angle in the clamping region 20. The front surface on the clamping region 20 thus, under the influence of an external force effect runs at an angle to the surface of the actual carrier 10. This is made possible by the flexibility of the clamping element 1 in the clamping region 20, here, by the profile being subdivided into chambers and by use of an elastic material. The force distribution is, thus, regular and gentle for the product. FIG. 6 also shows that the chamber walls 13 form a resistance, which impedes the drawing out of the product towards the bottom.

The clamping element shown in FIG. 7 substantially consists of a carrier 10 to which flat cushions 62 closed on all sides and filled with a liquid are attached, which cushions define the clamping regions 20, 20'. The carrier 10 is fixed by fixing elements 32 on the arms 43, 43', which here are designed in the manner of a rail. Instead of a cushion 62 a flat block 63 of an elastically deformable material (e.g. viscoelastically deformable) material could be used (FIG. 8).

The invention claimed is:

1. In a gripper for gripping an object, wherein the gripper comprises a T-shaped clamping tongue having a central clamping tongue part and first and second arms laterally protruding from opposite sides of the central clamping tongue part, a clamping element, the clamping element comprising:

an elongated carrier, the length of which substantially corresponds to the distance from a distal end of the first arm to a distal end of the second arm;

at least two mutually distanced clamping regions, on the elongated carrier, in which the clamping element, when in use, acts together with a gripped object or a counter clamping tongue, respectively, wherein the clamping regions are arranged on the elongated carrier such that, when the clamping element is attached to the clamping tongue, they are located in the regions of the first and second arms;

at least one fastening element for detachable fastening of the clamping element to the clamping tongue.

2. Clamping element according to claim 1, wherein the clamping regions are formed by an elastically deformable thickening on the elongated carrier.

3. Clamping element according to claim 1, wherein the clamping regions are formed by two elastic bodies and wherein the elongated carrier comprises a material bridge, which connects the elastic bodies to each other rigidly or elastically.

4. Clamping element according to claim 1, wherein the form of a front surface of the elongated carrier is variable in the clamping regions under the effect of force.

5. Clamping element according to claim 1, wherein the elongated carrier comprises a hollow profile with a basic layer and an elastically deformable covering layer distanced from it, wherein the distance between the basic layer and the covering layer is enlarged in the clamping regions in relation to other regions of the elongated carrier.

6. Clamping element according to claim 5, wherein the hollow profile comprises at least in the clamping regions several chambers with separating walls.

7. Clamping element according claim 1, wherein two fastening elements are provided, which are arranged on the elongated carrier on outer ends in its longitudinal direction.

8. Clamping element according to claim 1, wherein the elongated carrier as a whole is elastically deformable.

9. Clamping element according to one claim 1, wherein the fastening elements are formed by recesses in the elongated carrier, wherein the recesses comprise openings facing one another and orientated in a longitudinal direction.

10. Clamping element according to claim 1, wherein it is, at least in the clamping regions, treated such that it is ink repellent, in particular by comprising a non-stick coating or being manufactured of a material of low adhesion.

11. Gripper for gripping flat objects, in particular printed products comprising:

a first and a second clamping tongue that are pivotable in relation to one another about a pivot axis, such that the gripper may be brought into an open configuration or closed configuration respectively, wherein at least the first clamping tongue is T-shaped and comprises a central clamping tongue part and first and second arms protruding laterally from opposite sides of the central clamping tongue part;

clamping force generating elements for generating a clamping force between the clamping tongues in order to press the clamping tongues against each other in the closed configuration;

clamping elements that are arranged on distal ends of the clamping tongues, wherein the clamping elements of both clamping tongues lie on each other or on the flat object other in the closed configuration;

wherein at least one of the clamping elements comprises an elongated carrier, the length of which substantially corresponds to the distance from a distal end of the first arm to a distal end of the second arm;

at least two mutually distanced clamping regions, in which the clamping element, when in use, acts together with a gripped object or the other clamping tongue, respectively, wherein the clamping regions are arranged on the elongated carrier such that they are located in the regions of the first and second arms;

at least one fastening element detachably fastening the clamping element to the clamping tongue.

12. Gripper according to claim 11, wherein the at least one fastening element acts together with the clamping tongue or the arms respectively in one of a form and a force fitting manner.

13. Clamping element according to claim 1, wherein the form of a front surface of the carrier is, in the clamping regions, adaptable to the form and position of the gripped object or to a counter clamping tongue.

14. Clamping element according to claim 5, wherein the hollow profile comprises at least in the clamping regions several chambers with separating walls, which are orientated in oblique to the basic layer or the covering layer, respectively.

15. Clamping element according to claim 1, wherein the carrier as a whole is bendable in perpendicular to its longitudinal direction.

16. Clamping element according to one claim 1, wherein the fastening elements are formed by recesses in the elongated carrier, wherein the recesses comprise openings facing one another and orientated in longitudinal direction, the shape of which is adapted to the arms laterally arranged on the clamping tongue, such that the arms are insertable into the recesses.

17. Clamping element according to claim 1, wherein it, at least in the clamping regions, comprises a non-stick coating is manufactured of a material of low adhesion.

* * * * *